United States Patent [19]

Oskam

[11] Patent Number: 4,802,644

[45] Date of Patent: Feb. 7, 1989

[54] BLIND HEADRAIL BRACKET

[75] Inventor: Herman Oskam, Vlist, Netherlands

[73] Assignee: Hunter Douglas International N.V., Curacao, Netherlands Antilles

[21] Appl. No.: 150,574

[22] Filed: Feb. 1, 1988

[30] Foreign Application Priority Data

Feb. 5, 1987 [GB] United Kingdom ..... 8702604

[51] Int. Cl.[4] ..... A47H 1/14

[52] U.S. Cl. ..... 248/251; 160/902; 248/254

[58] Field of Search ..... 248/251, 252, 254, 262, 248/264, 300; 160/178.1, 902

[56] References Cited

U.S. PATENT DOCUMENTS

| | | | |
|---|---|---|---|
| 2,698,727 | 1/1955 | Rutledge | 248/264 |
| 2,792,999 | 5/1957 | Lorentzen | 248/264 |
| 3,247,893 | 4/1966 | Ford | 248/262 X |
| 4,235,406 | 11/1980 | Vecchiarelli | 248/251 |
| 4,237,957 | 12/1980 | Hensel | 160/178.1 |
| 4,265,423 | 5/1981 | Vecchiarelli | 248/264 |
| 4,411,401 | 10/1983 | Anderson | 248/251 X |
| 4,475,706 | 10/1984 | Anderson | 248/251 X |
| 4,643,238 | 2/1987 | Tachikawa et al. | 160/168 R |

FOREIGN PATENT DOCUMENTS 0059103 2/1982 European Pat. Off. .

*Primary Examiner*—Ramon O. Ramirez
*Attorney, Agent, or Firm*—Pennie & Edmonds

[57] ABSTRACT

A bracket for releasably securing a channel section blind headrail to a wall or ceiling, said channel section blind headrail including a web and front and rear upwardly extending flanges, each having an inturned rim at its upper free edge, said bracket including a main body securable to a wall or ceiling, spaced, forwardly extending portions on said body, recesses on the forward end of each said portion engageable by the inturned rim of the forward flange of the headrail, a separate member capable of limited horizontal movement relative to said main body, at least one lug on said separate member engageable under said rim on the rear flange of the headrail and a tongue on the forward end of said member, positioned to overlie the rim of the front flange and extend forwardly thereof sufficiently to enable the tongue to be forced forward to disengage the lugs from the rear rim said separate member provided with resilient means to urge it towards a rearward position to engage said lugs under the rim of the rear flange, and being movable forwardly, against the action of said resilient means, to disengage the lugs from said rim to allow said headrail to be released.

11 Claims, 1 Drawing Sheet

BLIND HEADRAIL BRACKET

The present invention relates to a bracket for releasably securing a channel section blind headrail to a wall or ceiling.

Many different types of bracket have been proposed for this purpose. Usually one uses a bracket adjacent each end and one or more brackets at an intermediate position along the length of the headrail, depending upon the length of the headrail.

U.S. Pat. No. 2,698,727 shows one form of bracket which includes an L-shaped main body which is securable to a wall or ceiling, or both, and has spaced forwardly extending portions, a recess at the forward end of each portion being engageable by an inturned rim of the forward flange of the headrail. A separate member is capable of limited horizontal movement relative to the main body and includes at least one lug which is engageable under the rim on the rear flange of the headrail.

One mounts the bracket by securing it to the wall or ceiling surface and subsequently one offers up the headrail and engages the front flange in the hook and then pivots the headrail around until it engages the abutment surface. One then has to carry out a certainly difficult operation of moving the separate member with one finger or some other tool so that it moves rearwardly and engages under the rear rim.

EP-A No. 0059103 uses rather a different arrangement in which a plastics material bracket is secured to the lower surface of a lintel and has a rear depending leg having a lower foot engageable under the rear rim. A front leg has associated therewith an upwardly and forwardly extending arm having a forwardly extending ledge thereon which engages under the front rim of the headrail. Engagement can be produced by hooking on the rear rim first and then turning the headrail upwardly at the front so that it slides over the ledge which is thereby caused to spring backwardly and when the front rim is up sufficiently high the ledge is caused to spring forwardly. The arrangement can be manually disengaged by pressing a part of the upwardly and forwardly extending arm manually. This construction shows some improvement over US-A-2698727 in that it is simpler to install.

However, it does not provide such a secure fixing and it does not provide any means for preventing longitudinal movement of the headrail. Where plastics material is used, the necessary considerable thickness of the material of the extending arm for disengagement results in a free space between the headrail and the mounting surface that remains clearly visible and unsightly.

It is now proposed, according to the present invention, that the main body and the member are formed by separate, thin metal components, the member having a horizontal part slidably interengaged in a horizontal plane with the body, and the member having a thin operating tongue projecting forwardly beyond the front end of the body to the extent that it will extend above and past the front flange of a headrail when mounted on the bracket, the member at the rear being provided with at least said one supporting part and with the U-shaped portion with two legs, which are angled with respect to the horizontal plane, said first leg being connected near or at one end of the horizontal part of the member and at the other end, through a web portion, to the second leg, said second leg having an abutment part substantially spaced from said web portion and positioned to abut a portion of said body to restrain said second leg, whereby, when a pulling force is exerted on said tongue, said legs flex and provide said resilient force.

Such a construction can readily be manufactured inexpensively, allows little play between the headrail and mounting surface, and yet provides a robust way of securing the headrail in position. The resilient means may comprise two U-shaped portions, with the legs extending in a generally vertical direction. By this positioning, the legs can have a considerable length and improved resilience.

In one particular embodiment, the abutment parts of the second legs can pass through notches inside arms of the body thereby to restrain said second leg in the manner described above, so that said second legs flex and provide said resilient force.

In one particular embodiment, at least the first legs of the U-shaped portions are inclined to downwardly and forwardly assist in guiding the rim of the rear flange of the headrail into position.

To enable the legs to be made sufficiently strong and to create and maintain the required level of resilience, and allow easy application of the wings, the second legs of the U-shaped portions advantageously project laterally and partly beyond the width of the body portion in the direction of length of the headrail when mounted on the bracket.

In one particular advantageous construction of the invention, at least one of the said second legs, near or at its free end, is provided with an extending part, e.g. in the form of a wing, which is laterally outwardly inclined towards the rear, a free end of said part being resiliently engageable with the rear flange or rim of the headrail and shaped to restrain the headrail against longitudinal movement. Such a construction obviates the necessity for special end brackets or other provisions that have hitherto been necessary to prevent longitudinal movement of the headrail. The part may engage the inner surface of the rear flange or rim of the headrail when in position and preferably the part, e.g. a wing may extend at an angle of 45 degrees with respect to the longitudinal direction of the headrail when installed.

There may be a wing on each side of the bracket absolutely to ensure the immobility of the headrail with respect to the bracket and the or each wing may be provided with an enlarged head portion to facilitate engagement and extend the contact surface.

This headrail movement retaining feature can also favourably be used with other brackets of this type and consequently the invention also includes brackets with the wing parts so constructed that the wing or wings engage the front flange or rim instead of the rear flange or rim. In fact two wings can be provided, one designed to engage the front flange and the other the rear flange.

Advantageously, at least the first leg of the U-shaped portions are preferably inclined downwardly and forwardly to assist in guiding the rim of the rear flange or headrail into position.

The main body is, as previously suggested, advantageously L-shaped, having a horizontal part and a vertical part, the horizontal part including said arms, each part being provided with an aperture for the passage of securing means e.g. a screw. The horizontal part may include a pair of upstanding projections which press into a horizontally downwardly facing surface, and the horizontal part is secured thereto by a screw passing through the associated aperture. This simplifies the mounting and whether or not the construction is formed to be L-shaped, it can be secured simply by one screw together with the action of the projections.

Desirably the tongue of the separate member is a U-shaped bridge positioned relative to the rim of a front flange of a headrail in said recess and dimensioned to extend sufficiently forwardly of the front rim of a headrail to allow a tool, such as a screwdriver, to be inserted to urge the separate member forwardly to enable said lugs to disengage from the rim of the headrail rear flange.

If the separate member has a width essentially equal to the spacing between the side walls, the separate member can be accurately guided for forward and rearward movement and it is preferred that the walls are provided with deformed portions to retain the separate member in position on the main body. Thus one can provide, from relatively inexpensive metal parts, each of which can easily be stamped and pressed, a structure which provides both for neat, accurate and secure holding of the headrail against a supporting surface, and also prevents the headrail from moving longitudinally.

In order that the present invention may more readily be understood, the following description is given, merely by way of example, reference being made to the accompanying drawing in which.

Figure 1:
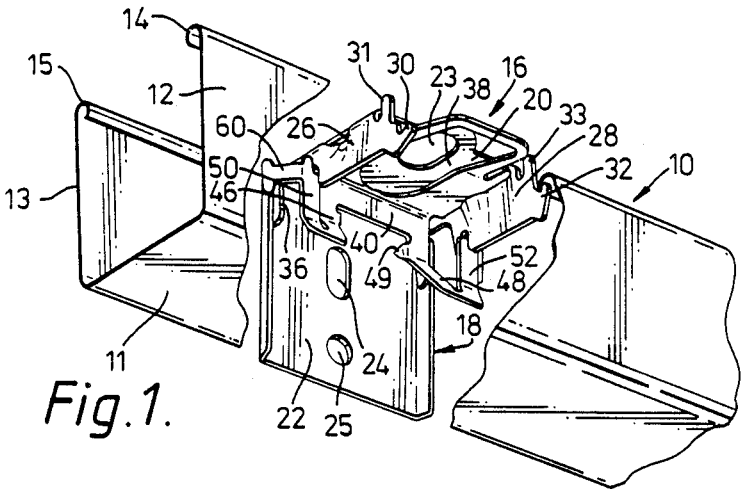
FIG. 1 is a perspective view, partly broken away, showing a headrail and one embodiment of bracket according to the invention.

Referring first to FIG. 1, there is illustrated therein a conventional headrail 10, for example for use with a venetian blind or other form of window covering. This is a U-shaped channel section having a web 11 and front and rear flanges 12 and 13 provided, respectively, with inturned rims 14, 15.

In order to mount the headrail the bracket 16 of the invention may be used. This bracket includes a main body 18 stamped out from sheet metal, this main body being of generally L-shape having a horizontal part 20 and a vertical part 22, these being provided with apertures 23, 24 and 25 for a reason to be explained below. Along each edge of the horizontal part 20 are formed downturned arms 26, 28 which terminate in upwardly opening hooks or recesses 30, 32. Immediately rearwardly of these hooks are two upstanding projections 31, 33, the upper extremities of which extend above the upper surface of the horizontal part 20.

Adjacent the rear end, the arms 26, 28 are each provided with a recess, the rearward edge of which forms an abutment surface 36.

Connected to, but movable relative to the main body 18 is a separate member 38 also formed of sheet metal. This has, at its rear, a bent down part 40 to which are attached two U-shaped portions 42, 44. These are formed of first legs 46, 48 which are directly connected to the bent down part 40, and second legs 50, 52 respectively. As can be seen more clearly in FIG. 2, the first legs 46, 48 and the lower parts of the second legs 50, 52 are inclined downwardly and forwardly.

Projecting rearwardly from the first legs, adjacent their connection to the bent down part 40, are two lugs 47, 49 which are cantilevered from the legs 46, 48 and extend themselves rearwardly and upwardly effectively as a continuation of the first legs 46, 48, the lugs 47, 49 forming supporting parts.

Figure 3:
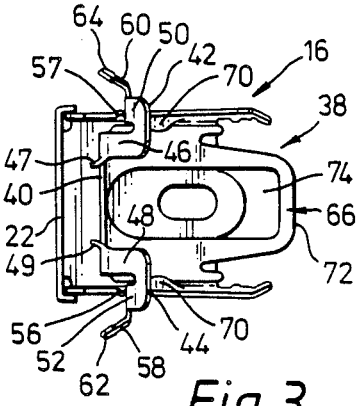
FIG. 3 is an underneath plan view of the bracket of FIGS. 1 and 2.
Figure 4:
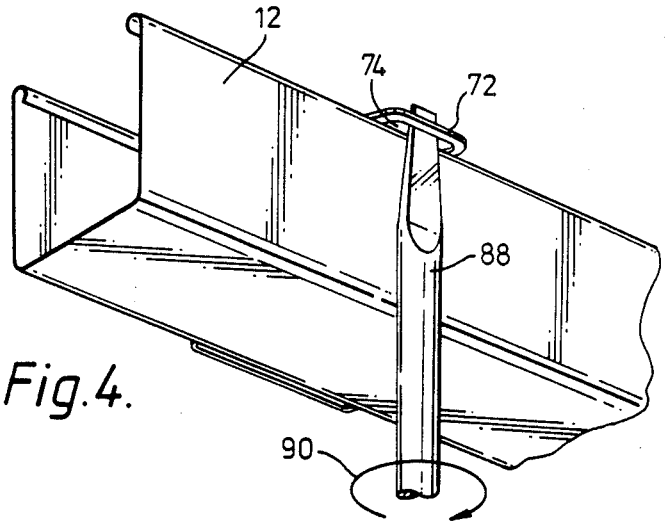
FIG. 4 is a view similar to FIG. 1 showing the tongue of a bracket in position being disengaged by means of a screwdriver.

Formed in the side arms 26, 28 are two notches 56, 57. The second legs 50, 52 extend laterally through the notches and are provided with wings 58, 60, which extend rearwardly and laterally at approximately 45 degrees as seen in FIG. 3. These wings have enlarged ends 62, 64. The second legs form abutment parts positioned to abut in said notches 56, 57 of the body at a position substantially spaced from the web portions connecting said second legs 50, 52 to said first legs 46, 48.

At its forward end, the separate member 38 is provided with a forwardly extending tongue indicated by the general reference numeral 66. The side edges of the separate member 38 are guided by the interior surface of the side arms, 26, 28 which act, therefore, to guide the separate member 38 for limited forward and rearward movement (to the left and right as seen in FIG. 3). In order to retain this separate member in place, the side arms 26, 28 are formed with two deformed portions 70.

The tongue 66 is in the form of a generally U-shaped bridge 72 which has within the bridge a space 74.

Figure 2:
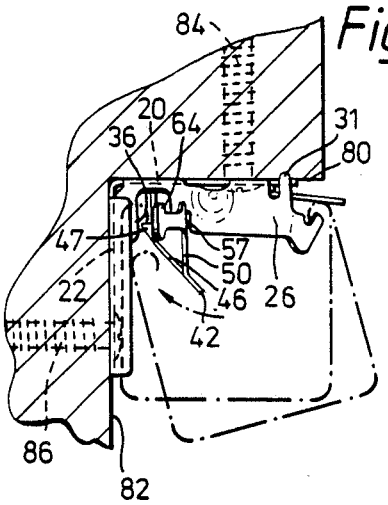
FIG. 2 is an end elevation of other bracket shown in FIG. 1 position adjacent a horizontal and vertical surface and showing two positions of the headrail in phantom.

In order to mount a headrail using a bracket according to the invention, the bracket is positioned, as shown in FIG. 2, adjacent a member having a horizontal surface 80 and a vertical surface 82 and screws 84, 86 are passed upwardly through the aperture 23 and horizontally through one of the apertures 24, 25. In some circumstances, it will be appreciated, there need only be either a vertical surface or a horizontal surface and the apertures shown will suffice. In particular, if there is only a vertical surface then two screws will be passed through the apertures 24, 25 and if there is only a horizontal surface, then one screw will be passed upwardly through the aperture 23 and as the screw tightens, the projections 31, 33 will embed in the horizontal surface 80 thereby preventing any rotation of the bracket.

With the bracket in position, the headrail 10 is offered up and the front rim 14 is engaged in the recesses 30, 32. The headrail is then pivoted rearwardly and the rear rim 15 is guided by the downwardly and forwardly extending part of the first legs 46, 48, which are forced forwardly slightly against the resilient action provided by the second legs 50, 52. As the rim moves upwardly it will move above the lugs 47, 49 and thereafter the separate member will spring back under the resilient action of the legs 50, 52. The lugs 47, 49 will then therefore be under the rim and will act as supporting parts to retain the rim in place.

Should one wish to remove the headrail, a screwdriver 88 or like implement can be inserted into the space 74 and either turned, as indicated by the arrow 90, or levered forward so that the lugs 47, 49 can become disengaged from the rear rim 15.

It should also be noted that when the headrail is in position, the enlarged ends 62, 64, of the wings 58, 60, are pressed against the inner surface of the rear rim 15 thereby making it very difficult for the handrail to move longitudinally. The wings, therefore, serve two functions. Firstly, they prevent this movement and at the same time they act to prevent the upper ends of the second arms from moving significantly, thereby retaining the U-shaped parts formed by the first and second arms in position on the main body 18 of the bracket.

The structure provided, therefore, is very simple and easy to manufacture from sheet metal, and yet provides a universal type of bracket which can be used at the end, or in the centre of a headrail and yet will not only secure the headrail in position, but will prevent the headrail from moving longitudinally, thereby obviating the necessity for making any special provision, which has hitherto been necessary, to stop longitudinal movement of the headrail.

I claim:

1. A bracket for releasably securing a channel section blind headrail to a horizontal or vertical surface, said channel section blind headrail including a web and upwardly extending front and rear flanges, each having an inturned rim at its upper free edge, said bracket comprising:

(a) a main body formed as a thin metal component securable to a vertical or horizontal surface;

(b) at least one supporting portion on the body, supportingly engageable with one of said rims;

(c) a member also formed as a thin metal component and movably associated with the body;

(d) at least one supporting part of said member supportingly engageable with the other rim, the member normally holding a first position with respect to the body, and being capable of being forcedly removed to a second position with respect to the body against a resilient force acting to hold it in the first position, in which second position the member cannot engage the other rim;

(e) a horizontal part of said member slidably interengaged in a horizontal plane with said body;

(f) a thin operating tongue on said member projecting forwardly beyond the front end of the body to the extent that it will extend above and past the front flange of a headrail when mounted on the bracket;

(g) at least one supporting part at the rear of said member;

(h) a U-shaped portion of said member with first and second legs and a web portion, said legs being angled with respect to the horizontal plane, the first leg being connected near or at one end to said horizontal part of the member and at the other end, through said web portion, to the second leg; and (i) an abutment of said second leg substantially spaced from and positioned to abut a portion of said body to restrain said second leg, whereby, when a pulling force is exerted on said tongue, said legs flex and provide said resilient force.

2. A bracket as claimed in claim 1, wherein the member is provided with two U-shaped portions, with the legs extending in a generally vertical direction.

3. A bracket as claimed in claim 2, wherein said body further comprises side arms having notches formed therein and wherein the abutment parts of said second legs pass through said notches in said side arms of said body to restrain said abutment parts of the legs relative to the body.

4. A bracket as claimed in claim 2, wherein at least the first legs of the U-shaped portions are inclined downwardly and forwardly to assist in guiding the rim of the rear flange of the headrail into position.

5. A bracket as claimed in claim 2, wherein the second legs of the U-shaped portions project laterally and partly beyond the width of the body in the direction of the headrail in a mounted position.

6. A bracket as claimed in claim 5, wherein at least one of said second legs near or at its free end further comprises an extending part, in the form of a wing, which is laterally outwardly inclined towards the rear, a free end of said extending part being resiliently engageable with the rear flange or rim of the headrail, and shaped to restrain the headrail against longitudinal movement.

7. A bracket as claimed in claim 1, wherein the main body further comprises a pair of upstanding projections extending above the body, which press into a horizontal downwardly facing surface, when said main body is secured thereto.

8. A bracket as claimed in claim 1, wherein the tongue of said member is a U-shaped bridge positioned to retain the rim of a front flange of a headrail in said supporting part and dimensioned to extend sufficiently forwardly of the front flange of a headrail to allow a tool, such as a screwdriver, to be inserted to urge the separate member forwardly to enable said supporting parts of the member to disengage from the rim of the headrail rear flange.

9. A bracket for releasably securing a channel section blind headrail to a horizontal or vertical surface, said channel section blind headrail including a web and upwardly extending front and rear flanges, each having an inturned rim at its upper free edge, said bracket comprising:

(a) a main body securable to a vertical or horizontal surface;

(b) at least one supporting portion of said body, supportingly engageable with one of said rims;

(c) a member movably associated with said body;

(d) at least one supporting part of said member supportingly engageable with the other rim, the member normally holding a first position with respect to the body, and being capable of being forcedly removed to a second position with respect to the body against a resilient force acting to hold it in the first position, in which second position the member cannot engage said other rim;

(e) a laterally extending part of said bracket in the form of a wing, which is laterally outwardly inclined; and (f) a free end of said part resiliently engageable with a rear flange or rim of the headrail, and shaped to restrain the headrail against longitudinal movement.

10. A bracket as claimed in claim 9, wherein the bracket is provided with two wings positioned on opposite sides of said bracket.

11. A bracket as claimed in claim 9 and further comprising an abutment surface on said body adjacent the rear end and engageable by the rear flange of the headrail.

* * * * *